United States Patent [19]

Taylor

[11] 4,093,294

[45] June 6, 1978

[54] RELEASABLE WIRELINE SPEAR

[76] Inventor: William T. Taylor, 222 Camp Lilly Rd., Humble, Tex. 77338

[21] Appl. No.: 583,774

[22] Filed: Jun. 4, 1975

[51] Int. Cl.[2] ..... E21B 31/02

[52] U.S. Cl. ..... 294/86.25; 294/94

[58] Field of Search ..... 294/86.25, 86.3, 86, 294/96, 86.1, 61, 86.12, 86.17, 86.18, 86.2, 86.21, 86.27, 86.31, 94; 166/138, 140, 206, 209, 216, 217; 285/31, 394; 175/256

[56] References Cited

U.S. PATENT DOCUMENTS

| | | | |
|---|---|---|---|
| 1,785,590 | 12/1930 | Miller | 294/86.25 |
| 3,108,637 | 10/1963 | Lee et al. | 294/86.25 |
| 3,380,528 | 4/1968 | Timmons | 294/86.25 |
| 3,638,988 | 2/1972 | Brown | 294/86.25 |
| 3,716,703 | 6/1970 | Templeton | 294/86.25 |
| 3,758,146 | 9/1973 | Kaercher | 294/86.25 |

*Primary Examiner*—James B. Marbert

*Attorney, Agent, or Firm*—Guy E. Matthews

[57] ABSTRACT

A releasable spear adapted to be run on a wireline or a tubing string, as desired, incorporates an elongate body and an external slidable sleeve. The sleeve is forced downwardly by a compressed spring at the top end of the sleeve. The sleeve supports a pair of internal projecting lugs which are received in an external groove formed in a tubular member. The lugs and groove function as a cam and cam follower mechanism controlling upward and downward movement. The body terminates in an elongate tapered plug. The lower end of the sleeve incorporates a set of collet fingers which have external upwardly facing serrations to lock on the interior of a fish. The external sleeve incorporates a protruding shoulder which catches the upper end of the fish. The cam and cam follower mechanism controls axial movement of the elongate tapered plug to force the collet fingers outwardly to engage, or cause them to deflect inwardly to disengage a fish.

11 Claims, 3 Drawing Figures

RELEASABLE WIRELINE SPEAR

RELATED APPLICATIONS

This application is partly related to subject matter disclosed copending patent application Ser. No. 583,773, filed of even date.

BACKGROUND OF THE INVENTION

As related in the copending application, it is often necessary to retrieve a fish from a well during drilling, completion, or workover activities. Many items are equipped with a standard API fishing neck, but this is not always the case. The present invention is an apparatus which retrieves those items which must be hollow, such as tubing. The present invention particularly finds application in retrieval of hollow members. It works with the apparatus in the related disclosure to provide a tool which enables retrieval of practically all types and shapes of fishes.

The present disclosure is to be contrasted with the related application. The present invention utilizes a similar cam and cam follower mechanism. It is able to be latched to on the interior of a fish and released readily. Connection with the fish and release therefrom are easily achieved by repetitive jarring motions which are accomplished without breaking any parts such as shear disks, shear pins, and so on. Engagement and disengagement of the tool with the fish is achieved with a minimum of effort.

The present invention is particularly able to be run on a wireline or can be connected at the bottom of a tubing string to enable fluid flow through the tubing string to wash through the tool to wash away sand or other debris which may block its use. When it is run on a wireline, the wireline can be readily manipulated to provide consecutive jarring motions through the use of mechanical or oil jars which impart the necessary jarring motion to the tool to cause it to engage or disengage. Engagement is achieved when a serrated set of fingers are expanded interiorally of a tubular member and brought into gripping contact with the inner surface, thereby enabling the tool to raise the fish. If the fish is stuck, a subsequent jarring action of the tool causes release and enables the tool to be retrieved. When this occurs, a heavier gauge cable and tool can be subsequently run and exposed to greater stress and strain.

SUMMARY OF THE INVENTION

The present invention is a spear-type retrieval tool for engaging a fish in a well. It incorporates an elongate body with a tubular sleeve thereabout. The sleeve is slidably mounted on he body and is urged downwardly by a compressed coil spring. Axial movement of the sleeve is controlled by a cam and cam follower mechanism. They preferably comprise a set of internally protruding pins carried on the sleeve which engage a shaped groove cut in the exterior of a tubular member. The tubular member is a portion of the elongate body captured between a pair of thrust washers so it is free to rotate. It moves relatively axially controlled by the cam followers which are the protruding pins. The lower end of the tubular body terminates in an elongate tapered plug which is positioned opposite to the tips of the several collet fingers appended to the lower end of the tubular sleeve. The collet fingers are equipped with teeth or serrations on the exterior surface. Since they are positioned opposite the tapered plug, they are forced outwardly against the fish to take a bite and retrieve the fish. The tubular sleeve has a protruding shoulder on the exterior which catches against the top end of the fish, thereby securing the tool at a position where a jarring operation will rotate the tubular member supporting the groove and thereby enable the cam and cam follower to relatively move the body and tubular member, shifting the lower end of the collet fingers relative to the tapered plug. This achieves the engaging and disengaging operation.

DESCRIPTION OF THE PREFERRED EMBODIMENT

Figure 1:
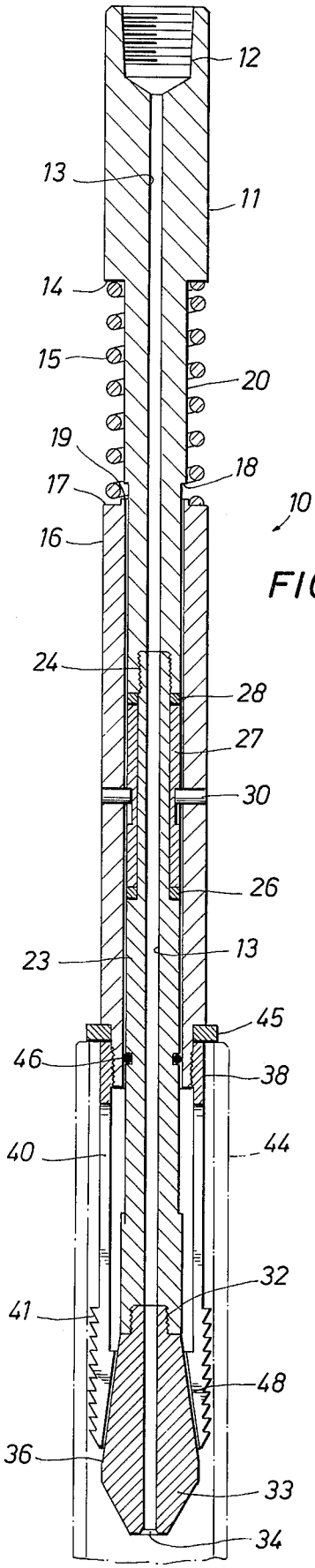
FIG. 1 is a lengthwise sectional view along a diameter of the fishing spear of the present invention showing details of construction including the cam and cam follower mechanism which enables it to shift axially in retrieving a fish.

In FIG. 1, a fishing spear 10 incorporates the advantages of the present invention. A tubular body 11 has a threaded female connection 12 at the upper end to enable it to be connected to a rope socket or to a tubing string. A rope socket is threaded at 12 to enable it to be run on a wireline. Wireline operation is normally more convenient, and this is the customary or intended use of the tool. However, when the spear 10 is to be run in a well where washing action is required to remove sand and debris, a tubing string is connected to the tool to enable washing fluid to be pumped through the tubing string and through the spear 10 to achieve washing or jetting action. The body 11 has an axial passage 13 to receive a washing fluid therethrough. It extends all the way to the bottom of the tool, as will be described.

The body 11 has a downwardly facing shoulder 14 which receives a coil spring 15 therein. For large spring forces, a stack of Bellville springs may be used. The coil spring 15 creates an axial force bearing on a slidably mounted tubular member 16. It is forced downwardly under movement controlled by a cam and cam follower mechanism to be described. The coil spring 15 bears against the upper shoulder 17 of the tubular body 16. A downwardly facing shoulder 18 cooperates with an upwardly facing shoulder 19 on the slidable sleeve 16 to limit upward travel of the sleeve 16. The shoulder 18 is formed on the exterior of a relatively narrow neck 20 which extends below the body 11. The neck 20 is fairly long and extends into the sleeve 16 as illustrated.

Figure 2:
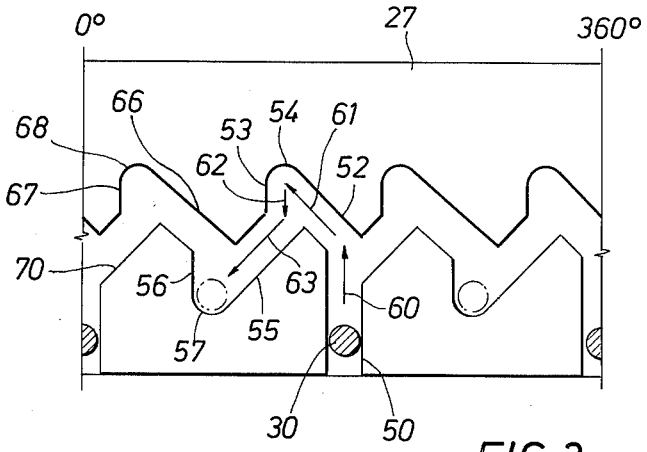
FIG. 2 discloses the groove arrangement on the exterior of the tubular member showing the exterior surface in planar presentation and illustrating the path followed by a protruding pin captured in the groove; and, FIG. 3 is a view through the lower portions of the tool showing the collet fingers engaged with the fish.

The elongate body is continued by threading a lower hollow member 23 into the lower end of the neck 20. A threaded connection is achieved at 24. The body 23 has the same external diameter as the neck 20 below the shoulder 18. It provides a continuation of the axial passage 13. The tubular body 23 has a reduced diameter at its upper end to enable it to receive a thrust washer 26 against a shoulder. The thrust washer is adjacent to a cam body 27. The cam body is just below a similar thrust washer 28. The components 26, 27 and 28 are telescoped on the tubular body 23 which is threaded to the threads 24. This captures the components on the relatively small neck appended to the upper end of the tubular body 23. The thrust washers and cam body are sized to have an external diameter which is equal to that of the neck 20 below the shoulder 18 and equal to the diameter of the tubular body 23. The thrust washers 26 and 28 capture the cam body 27 but do not hold it so snugly that it is prevented from rotating. It rotates on axial movement under control determined by a set of internally protruding pins 30 in the sleeve 16. The pins 30 have a length enabling them to extend into a groove cut in the exterior of the cam body 27. The shape of the groove is shown in FIG. 2.

The tubular member 23 has an internally threaded countersunk opening 32 at its lower end for receiving an elongate tapered plug 33. The passage which extends through the tubular body 23 also extends through the plug 33 and to an outlet 34 at the lower end. The plug 33 has an external surface 36 which is elongate and tapered. The surface 36 works with a set of collet fingers as will be described.

The tubular sleeve 16 is threadedly connected to a ring 38. The ring 38 supports a set of collet fingers 40. The collet fingers are defined by elongate grooves cut in the stock which extend upward to the ring 38. The grooves control the spacing of the fingers. Typically four fingers will suffice, although the numbers can be varied. The collet fingers are flexible to deflect outwardly under urging of the tapered plug 33. The collet fingers all terminate in a set of external serrations 41. The serrations take a bite in the fish shown in dotted line at 44. When they are forced against the fish, they grip it sufficiently to enable its retrieval. The serrations 41 face upwardly in that they define a sharp shoulder which faces upwardly of the fish.

The ring 38 threads to the tubular member 16 as previously noted. A protruding washer 45 is captured at the threaded connection. It extends outwardly by a distance sufficient to enable it to contact or find the top end of a fish. The protruding washer rests or supports the tool against the fish so that a portion of the tool is held stationary relative to the fish while another portion of the tool reciprocates in setting the tool to the engaged position. An O-ring 46 provides a seal against the intrusion of well fluids in the relatively small space between the tubular sleeve 15 and the elongate body.

Figure 3:
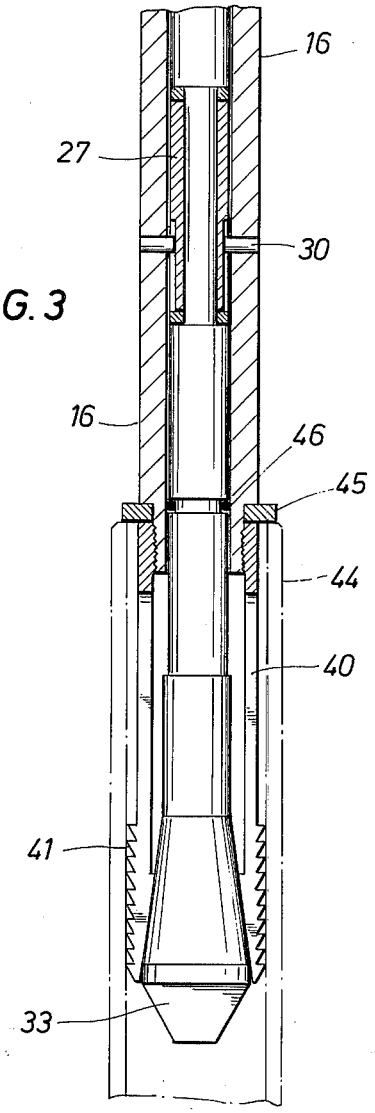

FIG. 3 should be contrasted with FIG. 1. FIG. 1 shows the apparatus in the disengaged position relative to the fish 44. In FIG. 3, the tapered plug 33 has been pulled upwardly relatively to the collet fingers 40. This axial movement of the plug forces the tapered plug 43 against the back side of the serrated collet fingers 40. The lower tips of the fingers 40 have a conforming back surface 48 which slides along the face of the tapered plug 33. The relative axial movement forces the tips of the collet fingers radially outwardly. This forces the serrations 41 into firm contact with the fish, thereby engaging the fish for retrieval. Retrieval is achieved by axially pulling on the spear 10 to retrieve the fish. The illustrated positions of FIGS. 3 and 1 disclose the engaged and disengaged positions. For a better understanding of its operation, the cam and cam follower mechanism which includes the pin 30 and cam body 27 will be described. The referenced disclosure utilizes the same cam and cam body arrangement inverted in comparison with the present disclosure. The cam and cam body mechanism provides controlled axial movement between two positions which differ axially and enable the tool to operate from an engaged to disengaged to engaged position repetitively.

In FIG. 2, a groove 50 extends to the lower end of the cam body 27. The groove 50 enables the cam body to be assembled and to capture the protruding pin 30 therein. At the time of assembly the thrust washer 26 is placed on the lower tubular body 23. The cam body 27 is dropped into the tubular sleeve 16 until it lands on the pins 30. It is rotated until the pins 30 find the grooves 50. The groove 50 is duplicated at 180° points about the body 27 so that it matches the position of the pins. A different number of pins could be used, but this is not necessary. The groove 50 is slightly larger in width than the diameter of the pin 30. This enables the pin 30 to move without binding. When received in he groove 50, the pin 30 defines a first position. The cam body and groove is so constructed to controllably move the pin between first and second stable positions. It is not necessary to achieve any other stable position. Movement of only one pin will be described although two pins are normally used. The preferred embodiment incorporates a pair of pins which are diametrically opposite one another as shown in FIG. 1. Inasmuch as each pin cooperates with a portion of the grooves on the exterior of the body 27 which is identically contoured, it is believed unnecessary to describe duplicate motions.

The groove 50 extends toward a facing wall 52 of an angled groove portion. It is opposite the groove and extends angularly relative to the groove 50 and causes the pin 30 to deflect along the illustrated path. The wall 52 and a wall 53 intersect in a curved groove shoulder 54. The shoulder 54 is curved and has a radius which fairly matches and exceeds that of the pin 30. This avoids point contact when the pin 30 moves into the intersection of the shoulders 52 and 53. The curved intersection 54 is located opposite a facing shoulder 55 which is set at an angle to intercept and deflect the moving pin. The shoulder 55 intersects a shoulder 56 at a curved intersection 57. The radius of curvature at 57 is about the same as that at 54.

The arrows 60 and 61 identify relative upward movement of the pin 30. It is one motion which is redirected by the facing shoulder 52. The pin 30 moves along the path indicated by the arrows 60 and 61 when a jarring motion is applied to the spear 10°. The path of the pin 30 continues along the direction indicated by the arrows 62 and 63. This is achieved in one motion but the pin 30 is deflected by the shoulder 55. The motion continues to the curved shoulder 57 where the pin 30 is captured in the second position. The reversal of sliding motion of the sleeve 16 relative to the body is achieved by contact of the shoulders 18 and 19 and not by rebound of the pin 30 in the groove.

The pin remains stable at the second position and remains there until the next operation of the tool. In traveling from the first to the second position, relative axial shifting of the cam body 27 is imparted to the tapered plug 33. This relative motion moves the tapered plug from the engaged to the disengaged position. This deflects the fingers outwardly or inwardly as the case may be to bring them into engagement or disengagement with the fish. Upward movement of the tubular member 16 is limited by the facing shoulders 18 and 19. They preferably engage just prior to travel of the pin 30 into the curved corner 54. This prevents the pin from receiving substantial shearing impact. On the rebound which occurs at the urging of the spring 15, the pin moves away from the curved corner 54 along the arrow 62.

The dotted line position of FIG. 2 represents the second position of the pin. It can rest there indefinitely. However, on subsequent operation, a jarring motion applied to the spear 10 carries the pin 30 from the curved corner 57 toward the oppositely facing shoulder 66. The shoulder 66 intersects the shoulder 67 at a curved or radiused corner 68. The corner 68 diverts and guides the pin in its travel and deflects it toward a facing shoulder 70. The facing shoulder 70 guides the pin back toward the lengthwise groove 50. In the groove 50 the pin is returned to the first position. Movement in the upward direction is achieved by a downward jar applied to the spear 10 while movement in the downward direction is achieved by rebound of the coil spring.

This describes movement of the pin in the cam body between the two positions. This movement enables the sphere to operate successively between engaged and disengaged positions repetitively, without limit.

It should be understood how the cam and cam follower mechanism control upward and downward movement of the relatively slidable parts of the present invention. Many details can be varied. The size and shape of the collet fingers and tapered plug are subject to variation depending on the circumstances of different fishing jobs. Other design details can be varied. The scope of the present invention is determined by the claims which follow.

I claim:

1. A spear comprising an elongate body having a connector means for supporting said body;

first means supported by said body;

an elongate set of collet fingers supported by said body and arranged in a circular fashion to engage the interior of a fish in a well, said fingers flexing to accommodate entry into the fish;

a tapered surface supported by said body adjacent to said collet fingers, said surface movable relative to said collet fingers which movement deflects said collet fingers radially inwardly and outwardly between fish engaging and disengaging positions;

cam means engaged by said first means which functions as a cam follower, said cam means and first means moving said collet fingers and tapered surface longitudinally of one another to deflect said collet fingers between fish engaging and fish disengaging positions, said cam means and said first means alternately moving between two positions, one associated with engaging and the other associated with disengaging a fish, said cam means and said first means being constructed and arranged to operate between the engaging and disengaging positions on relative axial downward movement of said body, said cam means comprising a tubular member rotatably positioned around said body which is limited in axial movement along said body by a pair of spaced shoulders which capture said tubular member therebetween;

a sleeve telescoped over said body, said sleeve supporting a pair of radially inwardly directed pins which comprise said first means; and said pins and said cam means forcing said body to move axially relative to said sleeve between the fish engaging and disengaging positions.

2. The apparatus of claim 1 wherein said sleeve is forced in an axial direction along said body by a resilient coil spring which abuts a shoulder carried by said body.

3. The apparatus of claim 1 wherein said sleeve supports a downwardly facing shoulder above said collet fingers which is adapted to engage the fish after insertion of said collet fingers into the fish; and said tapered surface is comprised of a tapered solid body which fits within said collet fingers.

4. The apparatus of claim 3 which includes a threaded connective socket at the upper end of said body and a lengthwise passage through said body from said socket which passage emerges at an opening in a tapered appendage adjacent to said collet fingers such that said passage enables a wash liquid to be flowed through said body and emerge in the vicinity of siad collet fingers.

5. A spear comprising an elongate body having a connector means for supporting said body;

first means supported by said body;

an elongate set of collet fingers supported by said body and arranged in a circular fashion to engage the interior of a fish in a well, said fingers flexing to accommodate entry into the fish;

a tapered surface supported by said body adjacent to said collet fingers, said surface movable relative to said collet fingers which movement deflects said collet fingers radially inwardly and outwardly between fish engaging and disengaging positions;

cam means engaged by said first means which functions as a cam follower, said cam means and first means moving said collet fingers and tapered surface longitudinally of one another to deflect said collet fingers between fish engaging and fish disengaging positions, said cam means and said first means alternately moving between two positions, one associated with engaging and the other associated with disengaging a fish, said cam means and said first means being constructed and arranged to operate between the engaging and disengaging positions on relative axial downward movement of said body;

a shoulder for contacting a fish, said shoulder encircling said collet fingers which extend beyond said shoulder and which collet fingers are adapted to encircle the fish;

an external slidably mounted sleeve supporting said shoulder and said collet fingers about said body which body supports and aligns said cam means longitudinally relative to said body which cam means cooperatively moves said body relative to said first means which movement alters the relative engagement of said first means and said cam means to the second position from the first position;

resilient means for urging one of said collet fingers and tapered surface relatively of the other to alter the deflection of said fingers; and means for controllably releasing a force from said resilient means on operation of said first means cooperative with said cam means, said means forcing said collet fingers to move relative to said tapered surface to alter the engaging position thereof.

6. The apparatus of claim 5 wherein said first means includes a pin extending interiorally of said body and said body has an axial chamber therein for receiving said cam means which comprises a groove means formed on the exterior of a tubular member movable in said chamber but with its movement constrained by co-action of said pin received in said groove means.

7. The apparatus of claim 6 wherein said cam means includes an endless groove which moves said pin from a first position to a second position and then to the first position all in a sequence of operation which returns the first means to a position from which said first means and cam means move repetitively between engaged and disengaged positions.

8. The apparatus of claim 7 wherein said endless groove moves said pin relatively toward one end of said tubular member and then toward the other end thereof, and including means engaging said tubular member which imparts relative longitudinal movement between said collet fingers and said tapered surface.

9. The apparatus of claim 5 wherein said cam means has a shoulder means which extends to a first location and to a second location which differ from one another and which guide said first means.

10. The apparatus of claim 9 wherein said shoulder means is constructed and arranged to limit said first means at the first location and direct said first means toward the second location which movement limits said first means in a subsequent movement.

11. The apparatus of claim 10 wherein said shoulder means extends toward both ends of an elongate tubular member which functions as said cam means, and said shoulder means has curved portions at the first and second locations which limit said first means in its movement which movement is achieved on relative lengthwise shifting of said tubular member.

* * * * *